US006352365B1

(12) United States Patent
Healy et al.

(10) Patent No.: US 6,352,365 B1
(45) Date of Patent: Mar. 5, 2002

(54) BAG WITH SPOUT

(75) Inventors: Steven Michael Healy, Topeka; Kendall William Petrie, Berryton, both of KS (US)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/634,446

(22) Filed: Aug. 8, 2000

(51) Int. Cl.[7] ..... B65D 30/24
(52) U.S. Cl. ..... 383/209; 383/100; 383/906
(58) Field of Search ..... 383/209, 906, 383/100, 103; 229/214

(56) References Cited

U.S. PATENT DOCUMENTS 2,093,977 A * 9/1937 Farmer ..... 383/906
2,093,978 A * 9/1937 Farmer ..... 383/906
3,502,487 A * 3/1970 Byrd ..... 383/103
3,663,239 A * 5/1972 Rowe et al. ..... 383/100
4,450,581 A * 5/1984 Hirata ..... 383/104
4,557,385 A * 12/1985 Robinson ..... 383/906
4,813,546 A * 3/1989 Gordon et al. ..... 229/125.42
5,219,229 A * 6/1993 Sengewald ..... 383/207
5,547,284 A * 8/1996 Imer ..... 383/104
5,593,229 A * 1/1997 Warr ..... 383/209
5,611,626 A * 3/1997 Warr ..... 383/906

* cited by examiner

*Primary Examiner*—Stephen P. Garbe
(74) *Attorney, Agent, or Firm*—Michael J. McGreal

(57) ABSTRACT

A bag suitable for relatively small amounts of products has a front wall and a rear wall, the front wall and rear wall attached through a pair of gusset sidewalls. The bottom of the bag is sealed to provide a base that will support the bag. The top of the bag has a lateral seal which at each end is a seal of the front wall and rear wall to a portion of the gusset sidewall. An end portion of the top lateral seal is removable through a weakened area to open the bag. When opened the upper part of the gusset sidewall is folded outward to form a spout. After product is dispensed form the bag, the gusset sidewall is pushed inward to substantially seal the bag. For subsequent dispensings, the gusset sidewall is pulled outward to open the bag and form the spout and then pushed inward to substantially close the bag.

10 Claims, 5 Drawing Sheets

BAG WITH SPOUT

FIELD OF THE INVENTION

This invention relates to a bag that has a structure such that when opened a spout is formed for easy pouring of the contents. More particularly this invention relates to a gusseted bag where a sidewall gusset forms a pour spout and readily recloses.

BACKGROUND OF THE INVENTION

Various products are sold in relatively small amounts but are dispensed in a plurality of dispensing operations. This makes it necessary that the bag be easy to handle, easy to open, and easy to dispense an amount of the contained product. The bag also must be reclosable to substantially close the bag contents from the atmosphere. The bags that require these benefits are those that will contain foods, special cements and coatings, plant and flower food, and other such products. This type of bag is very suitable for pet foods such as cat and dog foods and birdseed. These bags usually will contain from about 0.5 to 15 kilos of a dry product that should as much as possible remain dry. Consequently the bag must be reclosable.

The present bag meets all of these requirements. By the use of a gusset sidewall structure and the easy removability of a part of the top edge, a spout can be formed for dispensing and through the memory of the gusset sidewall, the spout is folded inward after use and the opening substantially closed.

BRIEF SUMMARY OF THE INVENTION

The bag is comprised of a front wall and a rear wall. The front wall and rear wall are connected by a pair of sidewalls. The bottom of the bag is sealed to form a base that will support a filled bag.

The sidewalls preferably are gusset sidewalls. A lateral seal traverses the top of the bag and will at the ends seal to the portions of the preferred gussets of the sidewalls. In a further preferred embodiment there is a vent which traverses the lateral seal whereby air pressure within and outside of the bag can be equilibrated.

A weakened area traverses through the lateral seal to a point below the lateral seal and then extends to a side end of the bag. This weakened area can be formed by a plurality of perforations or slits. The removal of the bag material defined by this weakened area opens the bag. The weakened area preferably traverses the lateral seal at the vent that is used to equilibrate the air pressure within and outside of the bag.

When the bag is opened the gusset sidewall is pulled outwardly to form a spout. The product in the bag then can be dispensed from the bag by pouring or otherwise. The bag is closed by pushing inwardly on the gusset sidewall to substantially close the bag. The bag than can be reopened by pulling outwardly on the sidewall gusset.

DETAILED DESCRIPTION OF THE INVENTION

The invention will now be described in its preferred embodiments with a reference to the drawings. The bag has a base sufficient to support the bag in vertical orientation, is easy to open, has a pour spout, and can be substantially closed after each dispensing.

Figure 1:
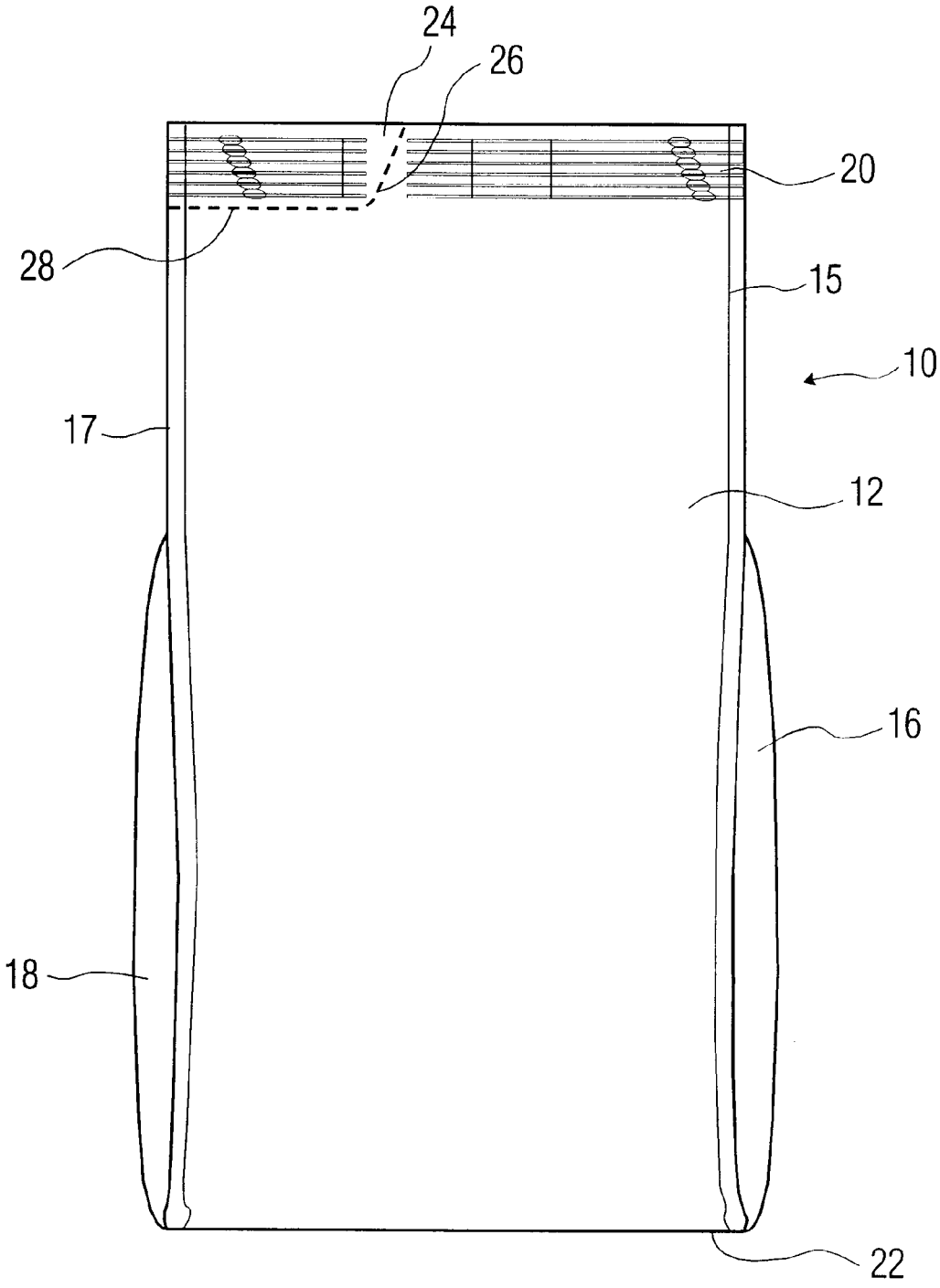
FIG. 1 is a front elevation view of the bag.
Figure 2:
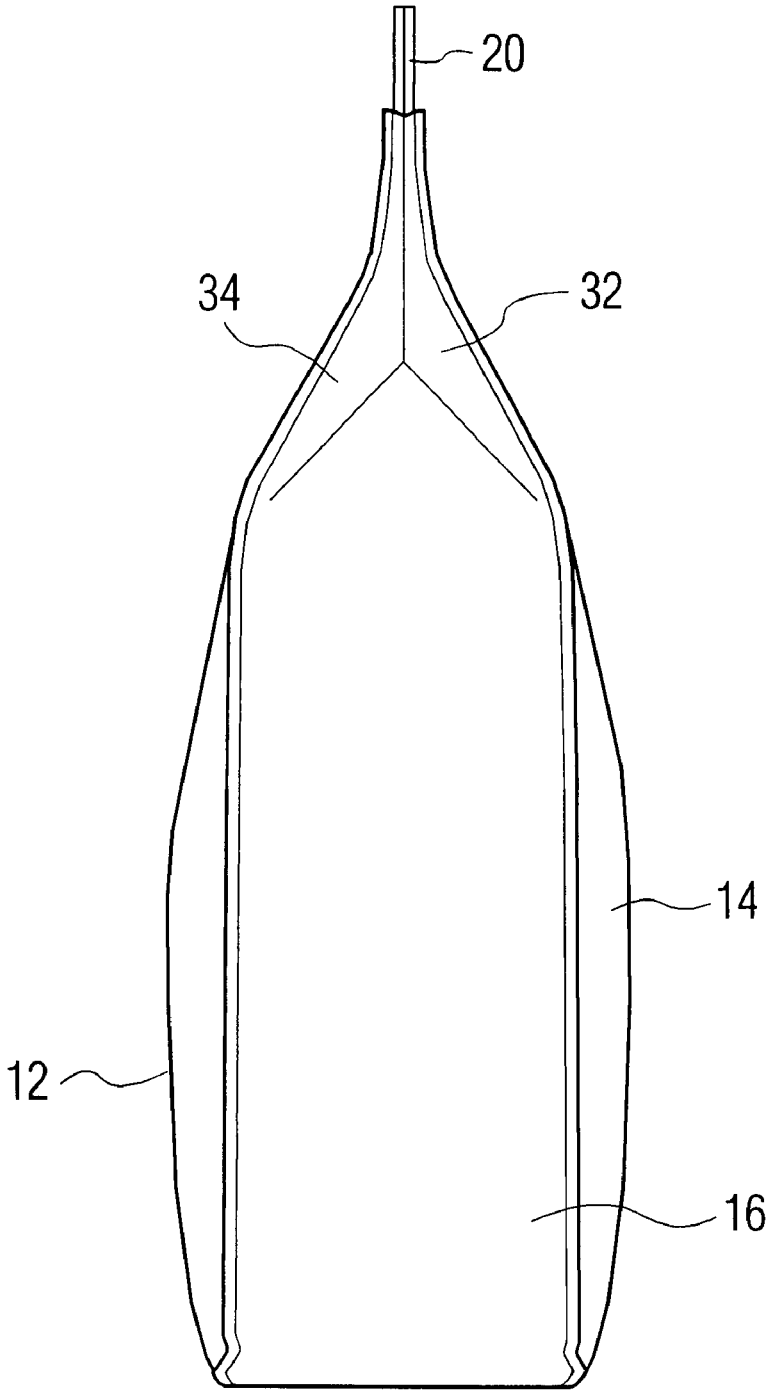
FIG. 2 is a side elevation view of the bag.

The bag 10 as seen in FIGS. 1 and 2 has front wall 12, rear wall 14, and sidewalls 16 and 18. The base 22 of the bag forms a platform support for the bag so that it is self-supporting in a vertical orientation. As seen in FIG. 2, the front wall 12 is attached to sidewall 16 by seal 15 and to sidewall 18 by seal 17. The rear wall 14 is attached to sidewall 16 by seal 19 and to sidewall 18 by seal 21. The top of the bag is closed by lateral seal 20. Disposed in the lateral seal is vent 24. A vent is preferred but is not a required feature. Traversing the lateral seal 20, and preferably at the vent 24, is weakened area 26 which joins weakened area 28 which extends to a sidewall of the bag. The weakened area is formed by a plurality of perforations or slits or a combination of perforations and slits. As an alternative the bag can be made using a tubular material. If the bag is made from tubular stock there will not be seals 15, 17, 19 and 21, but rather sharp creases at 15, 17, 19 and 21. These sharp creases and an intermediate crease in each sidewall will form a gusset structure.

The weakened area 26 may be made at the time that the seal 20 is made or after the seal 20 is made and this seal cooled. A perforating/slitting punch is used to make this weakened area. Usually if the bag is not to be vented, the weakened area will be made after the seal has been made and cooled.

Figure 3:
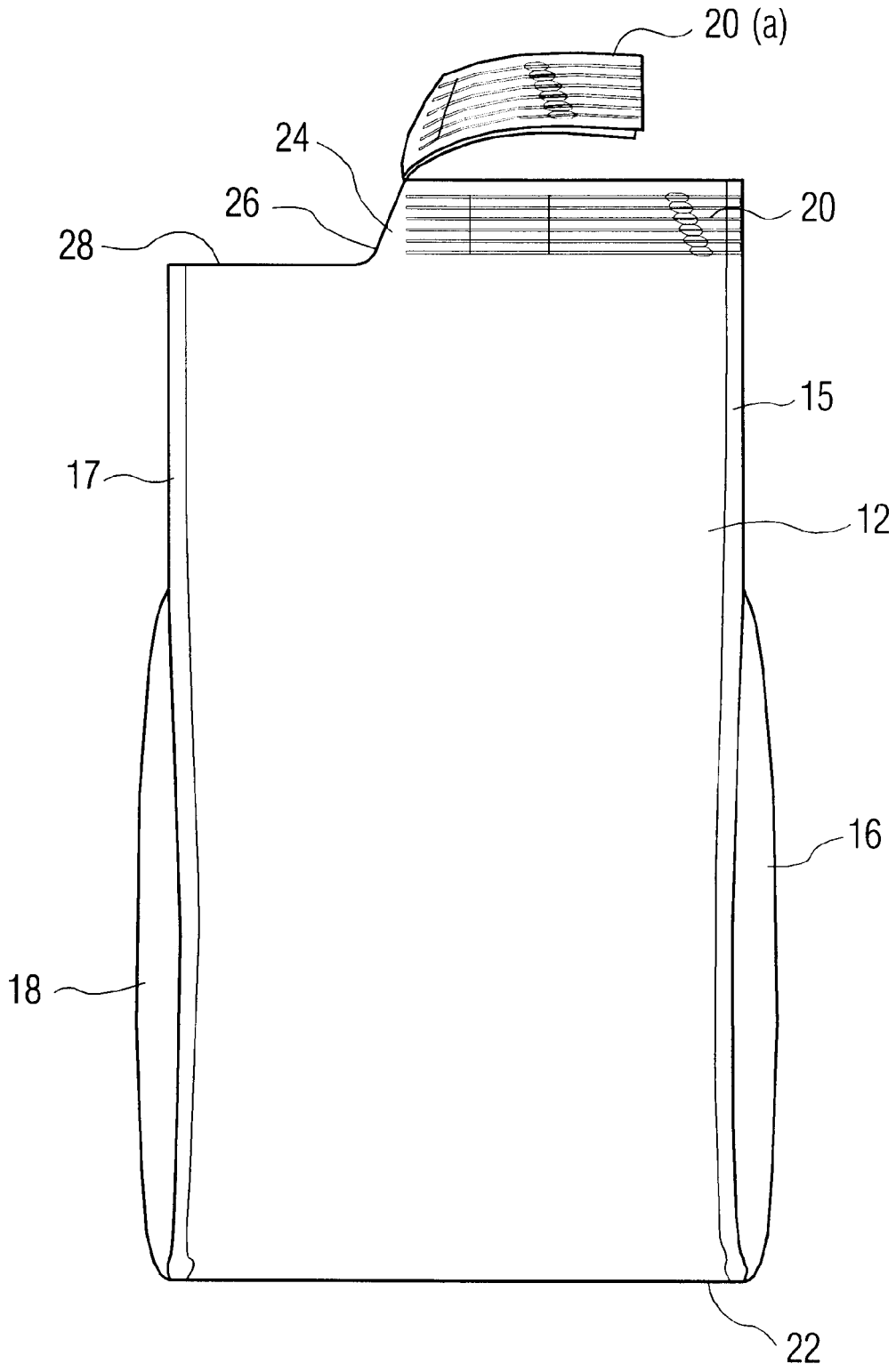
FIG. 3 is a front elevation view with a portion of the lateral seal substantially removed.
Figure 4:
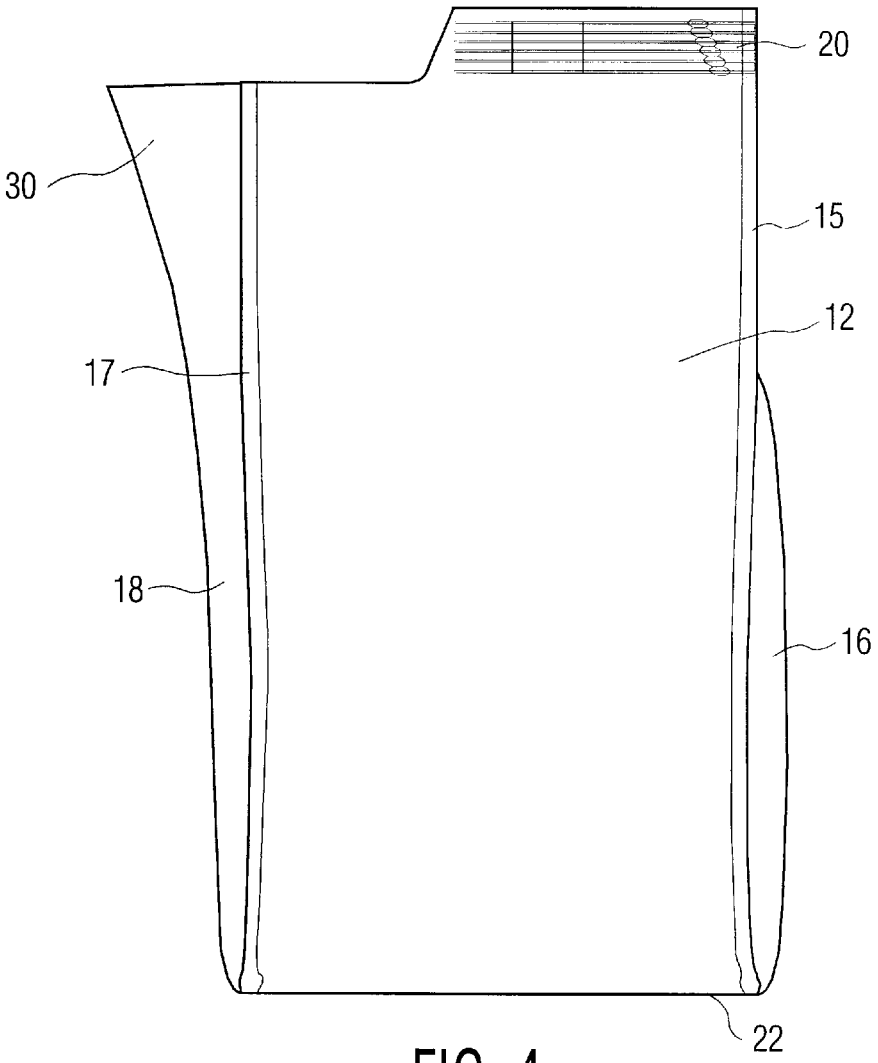
FIG. 4 is a front elevation view with a gusset sidewall forming a spout.
Figure 5:
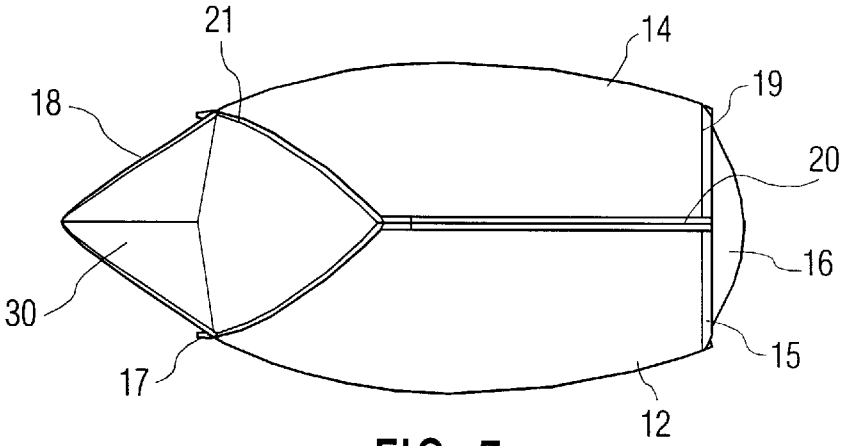
FIG. 5 is a top plan view of the bag of FIG. 4.
Figure 6:
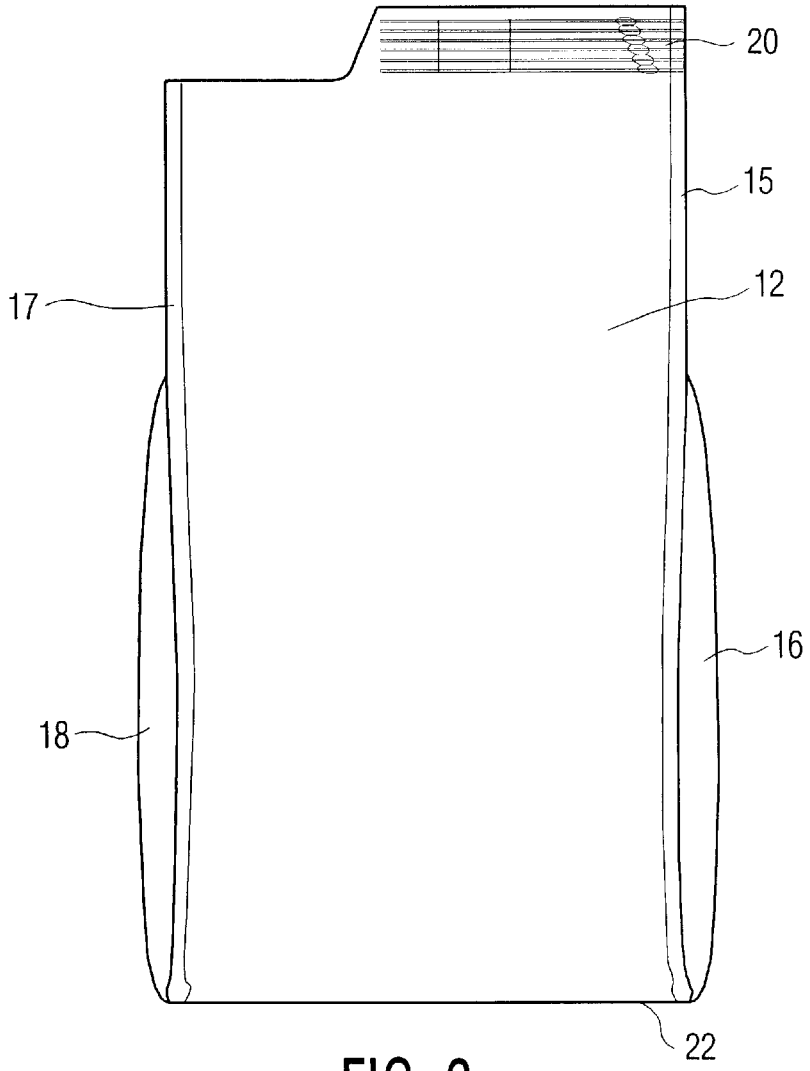
FIG. 6 is a front elevation of the bag reclosed.
Figure 7:
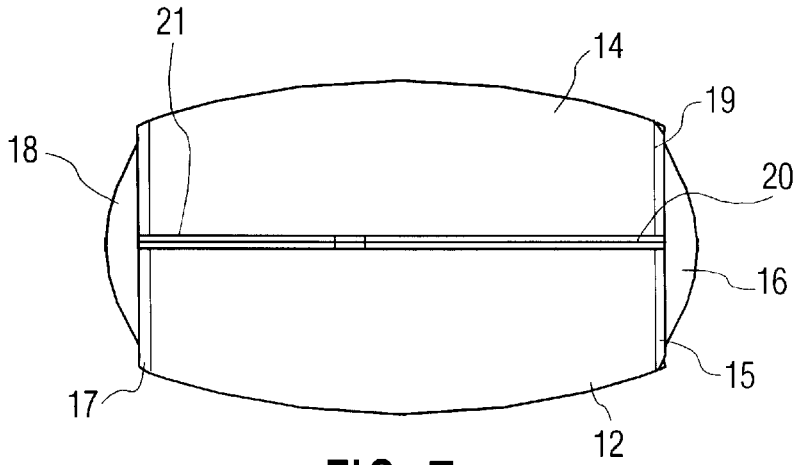
FIG. 7 is a top plan view of FIG. 5.

FIG. 3 shows the bag being opened by removal of a section 20(*a*) of the lateral seal 20. FIG. 4 shows portion 20(*a*) fully removed and the gusset of sidewall 18 pulled outwardly to form spout 30. FIG. 5 shows the opened bag in a top plan view. FIG. 6 shows the bag reclosed with the spout 30 removed by folding in the gusset of sidewall 18. The spout formed by the gusset folds inward with the gusset. FIG. 7 is a top plan view of FIG. 6.

The bag can be made out of essentially any single layer or multilayer material. The only significant limitation is that the material be reasonably easy to tear along the perforation. This can be accomplished by a coordination of single or multilayer materials and the structure of the perforations to satisfy the reasonably easy to tear requirement. The preferred materials are composite films comprised of plastic, paper and metal foil. The preferred materials are multilayer polyolefin films which may contain metalocene layers, ethylene vinyl alcohol layers, ethylene vinyl acetate layers, nylon layers and other films to provide specific barrier and strength properties. However, the bag can be made having essentially any wall structure.

What is claimed is:

1. A bag having a front wall and a rear wall, said front wall and rear wall joined by sidewalls and closed at a lower end to form a bag having a lateral seal at an upper end and a vent channel through said lateral seal, a weakened area disposed at least partially through said vent channel and extending to a sidewall of said bag.

2. A bag as in claim 1 wherein said sidewalls are gusset sidewalls.

3. A bag as in claim 2 wherein said weakened area extends through the gusset structure of at least one of said sidewalls.

4. A bag as in claim 1 wherein said weakened area is comprised of a plurality of perforations.

5. A bag as in claim 1 wherein said weakened area is a plurality of slits.

6. A bag as in claim 2 wherein said lateral seal at the side edges of said bag is a seal of the front wall and the rear wall to a portion of a gusset sidewall.

7. A bag as in claim 1 wherein said closed lower end is sealed to provide a base sufficient in size to support said bag.

8. A method for dispensing product from the bag of claim 1 comprising removing a top portion of said bag delineated by said weakened area at least partially through said vent, pulling outwardly on the top of a sidewall from which the weakened area has been removed to form a spout, dispensing the product from said bag, and substantially closing the bag by pushing inwardly on said gusset sidewall.

9. A method as in claim 8 wherein said sidewalls are gusset sidewalls.

10. A method as in claim 9 wherein said weakened area extends through the gusset structure of at least one of said sidewalls.

* * * * *